US008166791B2

(12) United States Patent
Baba et al.

(10) Patent No.: US 8,166,791 B2
(45) Date of Patent: May 1, 2012

(54) DIE CUSHION DEVICE

(75) Inventors: Kiyokazu Baba, Komatsu (JP); Hiroaki Honma, Komatsu (JP); Masahide Sunata, Komatsu (JP); Hajime Yoshida, Komatsu (JP); Hirohide Satou, Komatsu (JP)

(73) Assignees: Komatsu Ltd, Tokyo (JP); Komatsu Industries Corp., Tokyo (JP); Toyota Jidosha Kabushiki Kaisha, Toyota-shi (JP)

( * ) Notice: Subject to any disclaimer, the term of this patent is extended or adjusted under 35 U.S.C. 154(b) by 894 days.

(21) Appl. No.: 11/794,965

(22) PCT Filed: Jan. 12, 2006

(86) PCT No.: PCT/JP2006/300290

§ 371 (c)(1),
(2), (4) Date: Jul. 10, 2007

(87) PCT Pub. No.: WO2006/075660

PCT Pub. Date: Jul. 20, 2006

(65) Prior Publication Data

US 2008/0127838 A1 Jun. 5, 2008

(30) Foreign Application Priority Data

Jan. 14, 2005 (JP) ..... 2005-007800

(51) Int. Cl.

| | |
|---|---|
| ***B21D 22/00*** | (2006.01) |
| ***B21J 9/18*** | (2006.01) |
| ***B30B 13/00*** | (2006.01) |
| ***B30B 1/32*** | (2006.01) |

(52) U.S. Cl. .... 72/350; 72/453.13; 100/35; 100/269.18; 100/918

(58) Field of Classification Search ..... 72/350, 72/351, 453.13, 455; 267/119, 130, 140, 267/152, 153; 100/269.18, 35, 918; 248/633
See application file for complete search history.

(56) References Cited

U.S. PATENT DOCUMENTS 2,233,164 A * 2/1941 Glasner ..... 72/455
(Continued)

FOREIGN PATENT DOCUMENTS

DE 4100206 A1 7/1992
(Continued)

OTHER PUBLICATIONS

German Office Action (and English translation thereof) dated Jul. 17, 2008, issued in a counterpart German Office Action.

(Continued)

*Primary Examiner* — Teresa Ekiert
(74) *Attorney, Agent, or Firm* — Holtz, Holtz, Goodman & Chick, PC

(57) ABSTRACT

A die cushion pad 13 is divided into four small pads 15 and a large pad 16. With this arrangement, a load applied to an action point of each of the small pads 15 can be equalized by the large pad 16, and an overturning moment arising between the action point and a reaction force point that equates the center of the small pad 15 can be canceled, thereby preventing flexure of the small pad 15. Accordingly, since flexure of the cushion pin and the like can be prevented, there is no risk that the cushion pin is frictioned against the penetrating hole of a bolster, and the lifting operation can be smoothly performed, whereby a higher-accuracy pressing forming operation can be realized.

20 Claims, 8 Drawing Sheets

U.S. PATENT DOCUMENTS

| | | | | | |
|---|---|---|---|---|---|
| 5,138,857 | A | * | 8/1992 | Siegert | 72/453.13 |
| 5,255,552 | A | | 10/1993 | Bielfeldt | |
| 5,435,166 | A | * | 7/1995 | Sunada | 72/351 |
| 5,692,405 | A | * | 12/1997 | Kirii | 72/351 |

FOREIGN PATENT DOCUMENTS

| | | | |
|---|---|---|---|
| EP | 0401534 | A1 | 5/1990 |
| JP | 5-7945 | A | 1/1993 |
| JP | 05-309426 | A | 11/1993 |
| JP | 6-543 | A | 1/1994 |
| JP | 6-544 | A | 1/1994 |
| JP | 7-100552 | A | 4/1995 |
| JP | 7-266099 | A | 10/1995 |
| JP | 10-166072 | A | 6/1998 |
| JP | 10-202327 | A | 8/1998 |
| JP | 10-263898 | A | 10/1998 |
| JP | 2006-908 | A | 1/2006 |
| JP | 2006-26738 | A | 2/2006 |

OTHER PUBLICATIONS

Notification Concerning Transmittal of International Preliminary Report on Patentability and Written Opinion, Chapter I of the Patent Cooperation Treaty for PCT/JP2006/300290 dated Jul. 17, 2007. 4 sheets.

Japanese Office Action dated Nov. 16, 2010 (and English translation thereof) in counterpart Japanese Application No. 2005-007800.

* cited by examiner

DIE CUSHION DEVICE

This application is a U.S. National Phase Application under 35 USC 371 of International Application PCT/JP2006/300290 filed Jan. 12, 2006.

TECHNICAL FIELD

The present invention relates to a die-cushion device having a die-cushion pad.

BACKGROUND ART

A die-cushion device has been used in drawing-forming a workpiece with a pressing machine. Such a die-cushion device includes a die cushion pad supporting a blank holder via a cushion pin, and the die cushion pad is lowered in synchronization with a movement of a slide on which an upper die is mounted.

According to a recent suggestion, the die cushion pad is divided into a plurality of pad members, each of which is individually driven by a servo motor as a biasing force generating means so as to control a cushion force per pad member, such that a high-accuracy press forming operation may be performed (for example, see Patent Document 1).

[Patent Document 1] JP-A-06-543

DISCLOSURE OF THE INVENTION

Problems to be Solved by the Invention

However, when the die cushion pad is divided into a plurality of pad members, an overturning moment whose value is different from pad member to pad member is applied between an action point of the pad member and a reaction force point at the center of the pad member during a drawing-forming operation. Accordingly, each of the pad members is flexed and barred from being smoothly lowered, and the high-accuracy pressing forming operation has been limited.

An object of the present invention is to provide a die-cushion device that can smoothly lower a die cushion pad, whereby a higher-accuracy pressing forming operation can be realized.

Means for Solving the Problems

A die-cushion device according to an aspect of the present invention is a die-cushion device provided to a pressing machine, including: a plurality of small pads applied with a pressing force of a slide via a cushion pin; a large pad supporting the plurality of small pads; and a biasing force generating means lifting up and down the large pad while generating an upward biasing force against the pressing force, in which a die cushion pad is provided by the small pads and the large pad.

According to the aspect of the present invention, since an action force applied to each of the small pad parts during a drawing-forming operation is equalized owing to the presence of the large pad, overturning moments caused by the action force are mutually offset to be reduced, whereby flexure of the small pad can be prevented. Accordingly, a cushion pin abutting the small pad can pass through a bolster without resistance, and the die cushion pad can be smoothly lowered without difficulty, whereby a high-accuracy pressing forming operation can be realized.

According to the aspect of the present invention, it is preferable that, in the die-cushion device, the small pads and the large pad are integrally fixed together.

According to the aspect of the present invention, since the small pad and the large pad are fixed by a fastening member such as a bolt, the action force on the small pad can be reliably and equalized owing to the large pad. Thus, the arrangement is more advantageous.

According to the aspect of the present invention, it is preferable that, in the die-cushion device, only the large pad is guided to be lifted up and down by an inner wall of a bed of the pressing machine.

According to the aspect of the present invention, since only the large pad, which is hardly flexed, is guided by the inner walls of the bed to be lifted up and down, the small pad, which is more or less flexed due to the overturning moment, can be lifted up and down without contacting the inner walls of the bed, thereby stabilizing a reaction force applied by the inner walls of the bed. Accordingly, when the die cushion pad is lowered in synchronization with the slide movement, a cushion pressure is less influenced by the reaction force, thereby facilitating a control of the biasing force generating means.

According to the aspect of the present invention, it is preferable that, in the die-cushion device, total four of the small pads are disposed in two lines and two rows, and the large pad is a single large pad supporting the four small pads.

According to the aspect of the present invention, the action force of the small pad can be equalized using front, rear, right and left small pads, and the overturning moment arising on each of the small pads can be canceled, such that the overturning moment can be close to zero. Thus, the arrangement is advantageous.

EXPLANATION OF CODES

1: pressing machine;
4: slide;
6: bed;
10: die-cushion device;
11: blank holder;
12: cushion pin;
13: die-cushion pad;
14: biasing force generating means;
15: small pad; and
16: large pad.

BEST MODE FOR CARRYING OUT THE INVENTION

An embodiment of the present invention will be described below with reference to the attached drawings.

Figure 1:
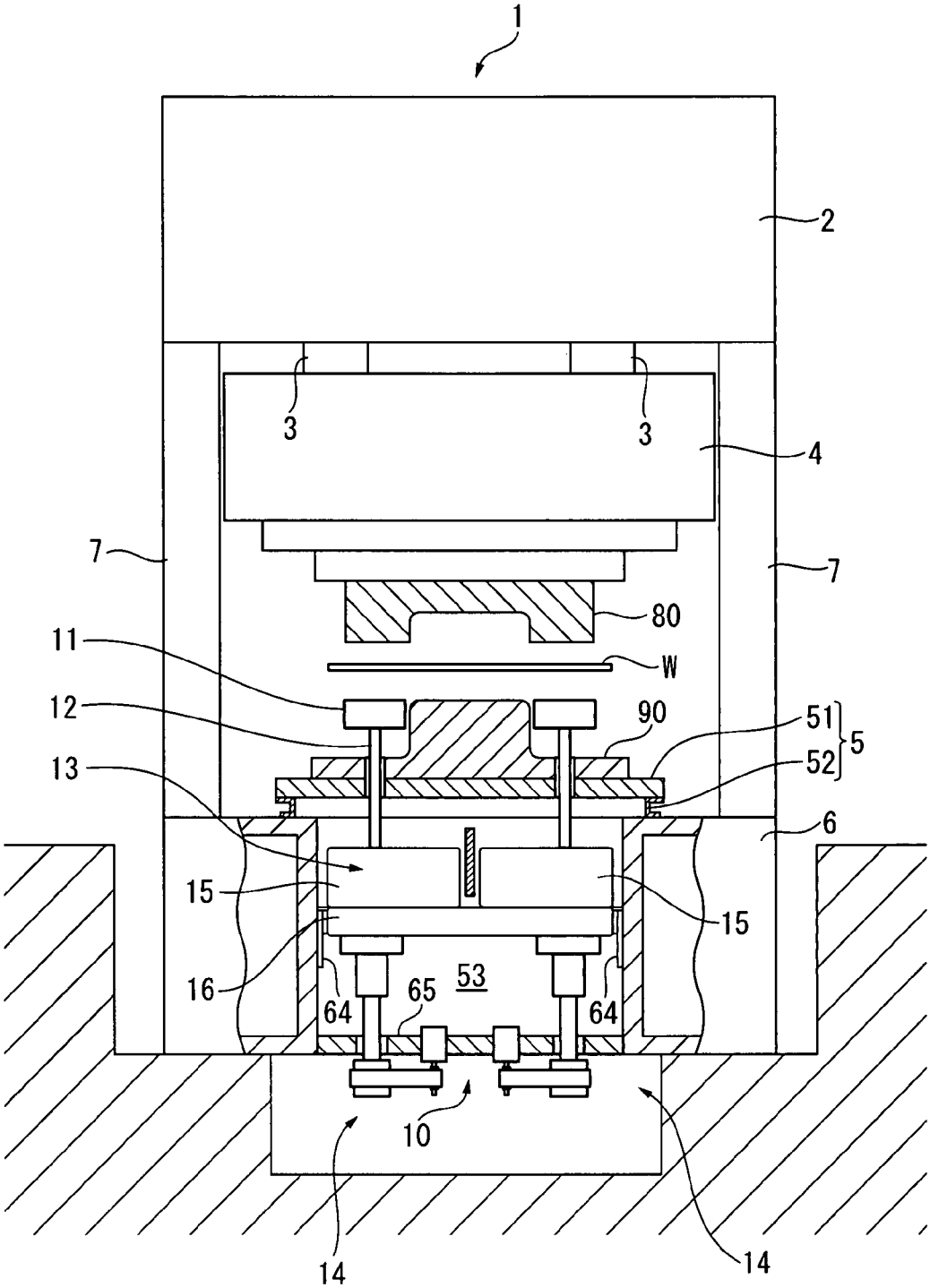
FIG. 1 is a schematic view showing an overall arrangement of a pressing machine using a die-cushion device according to an embodiment of the present invention.
Figure 2:
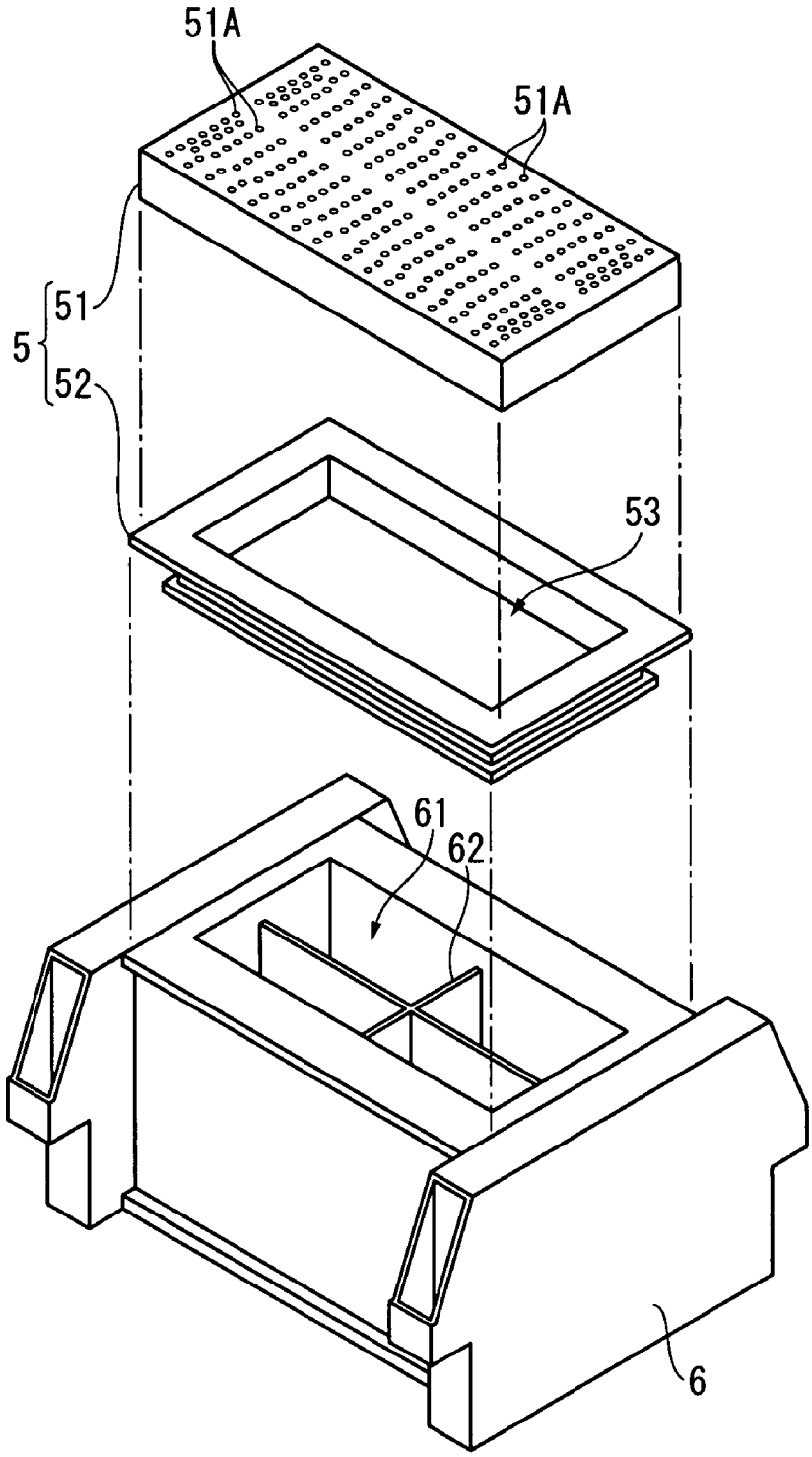
FIG. 2 is an exploded perspective view showing a primary portion of the pressing machine.
Figure 3:
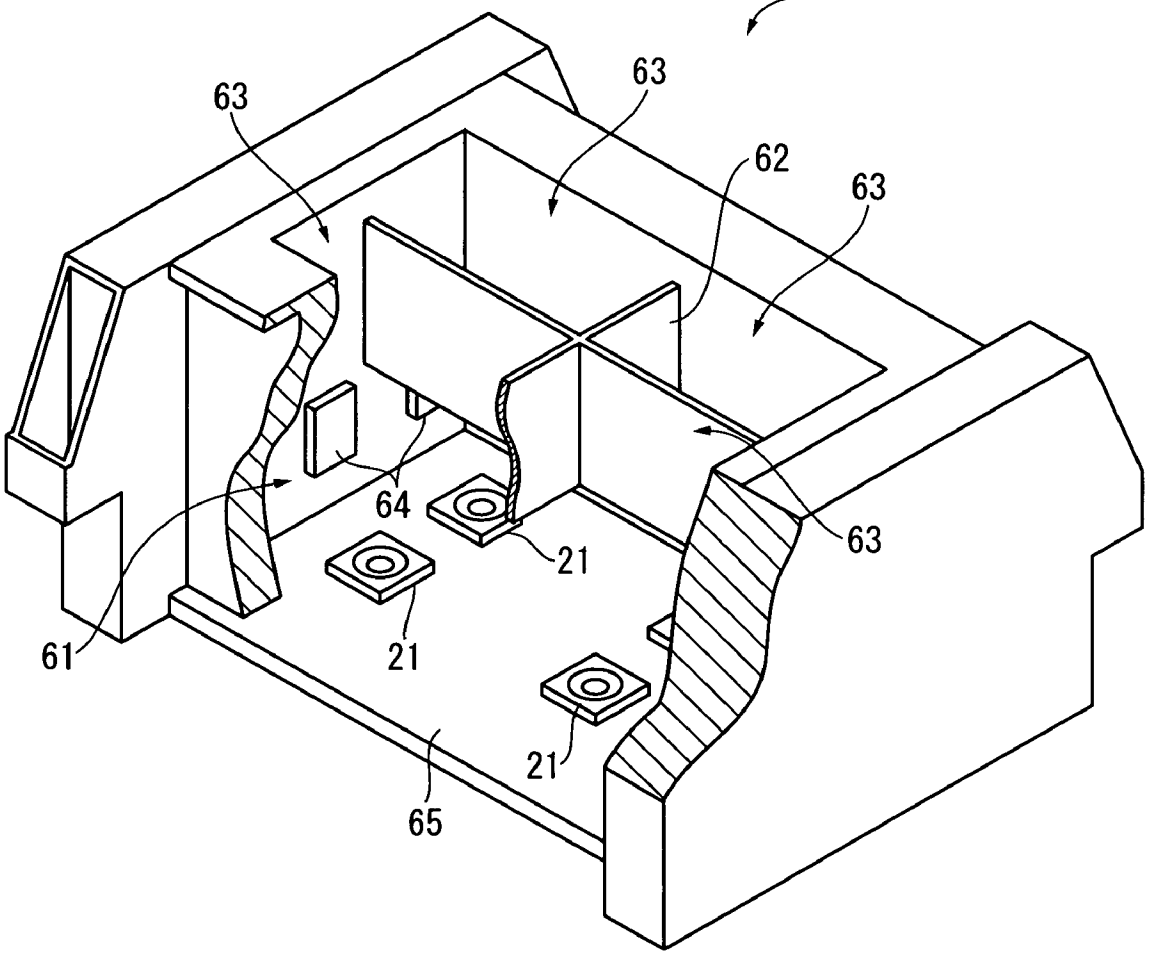
FIG. 3 is an enlarged view showing a primary portion of a bed of the pressing machine.

FIG. 1 is a schematic view showing an overall arrangement of a pressing machine 1 using a die-cushion device 10 according to the present embodiment, FIG. 2 is an exploded perspective view showing a primary portion of the pressing machine 1, and FIG. 3 is an enlarged view showing a primary portion of a bed 6 of the pressing machine 1.

The pressing machine 1 includes: a crown 2 having a built-in driving force transmission mechanism such as a crank mechanism, eccentric mechanism and link mechanism; a slide 4 attached with an upper die 80 and connected to the driving force transmission mechanism inside the crown 2 via a plunger 3; a bed 6 on which a moving bolster 5 attached with a lower die 90 is mounted; and four uprights 7 (FIG. 1 shows only two of the uprights) connecting the bed 6 and the crown 2. The die-cushion device 10 is housed inside the bed 6.

As shown in FIG. 2, the moving bolster 5 according to the present invention includes: a platen-like bolster 51 on which a number of penetrating holes 51A are formed; and a carrier 52 supporting the bolster 51. A cushion pin 12 (FIG. 1) employed in the die-cushion device 10 is inserted into the penetrating hole 51A of the bolster 51, which is selected in accordance with the lower die 90 to be used. The carrier 52 is provided with a moving means (not shown), which allows the bolster 51 to be moved outside the pressing machine 1 for a die replacement. An inner space 53 is formed on the carrier 52.

On the other hand, a cross-shaped rib 62 is provided to the bed 6 such that the rib 62 divides an inner space 61 into four parts in plan view. As shown in FIG. 3, the rib 62 is provided in a middle of an up-and-down direction of the inner space 62. Particularly, a lower end of the rib does not downwardly extend to a bottom surface separation portion.

Referring back to FIG. 1, the die-cushion device 10 has a blank holder 11 for holding a workpiece W against the upper die 80; the die-cushion pad 13 for supporting the blank holder 11 via the cushion pin 12; and a biasing force generating means 14 for generating an upward biasing force to lift up and down the die-cushion pad 13. Note that there are two types of biasing force generating means: one type passively lifts up and down the die cushion pad relative to the slide movement, an example of which is an air-cylinder type using air compressibility; and the other type actively drives the die cushion pad to be lifted up and down in synchronization with the slide movement using a servo motor 24 (FIG. 5) as in the present embodiment.

Figure 4:
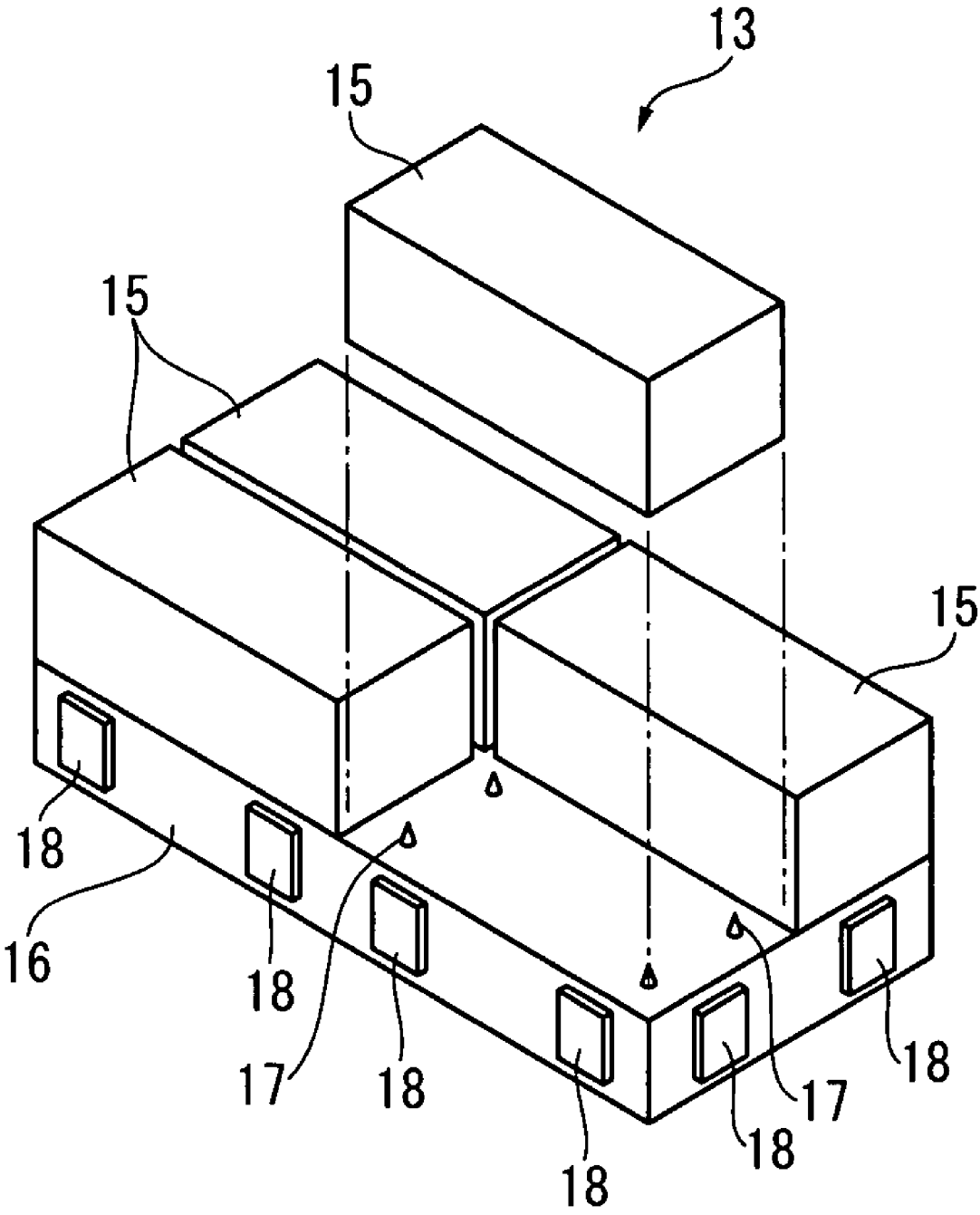
FIG. 4 is a perspective view showing a die-cushion pad of the die-cushion device.

As shown in FIGS. 1 and 4, in the die-cushion device 10, the die cushion pad 13 is provided by: four small pads 15 lifted up and down inside a small space 63 partitioned by the rib 62; and a large pad 16 positioned below the small pads 15 that are arrayed in two lines and two rows. Specifically, the large pad 16 is lifted up and down below the rib 62 inside the inner space 61 so as not to interfere with the rib 62.

The small pad 15, which is a hollow rectangular metal box, is put into the small space 63 from an upper side of the rib 62 relative to the large pad 16 that is arrayed below the rib 62 in advance. The small pad 15 is guided by a guide pin 17 or the like to be positioned on the large pad 16, such that the small pad 15 is integrally fixed to the large pad 16 by a bolt or the like (not shown).

On the other hand, a guide plate 18 is provided on four circumferential lateral sides of the large pad 16, which is also a hollow rectangular metal box. The guide plates 18 face guide plates 64 provided on inner walls of the inner space 61 of the bed 6 shown in FIG. 3. The guide plates 18 and the guide plates 64 slide in contact with one another, and guide the lifting up and down of the die-cushion pad 13. In short, when the die cushion pad 13 is lifted up and down, only the large pad 16 contacts the inner walls of the bed 6 via the guide plates 18, 64, and the small pad 15 does not contact the inner walls.

Figure 5:
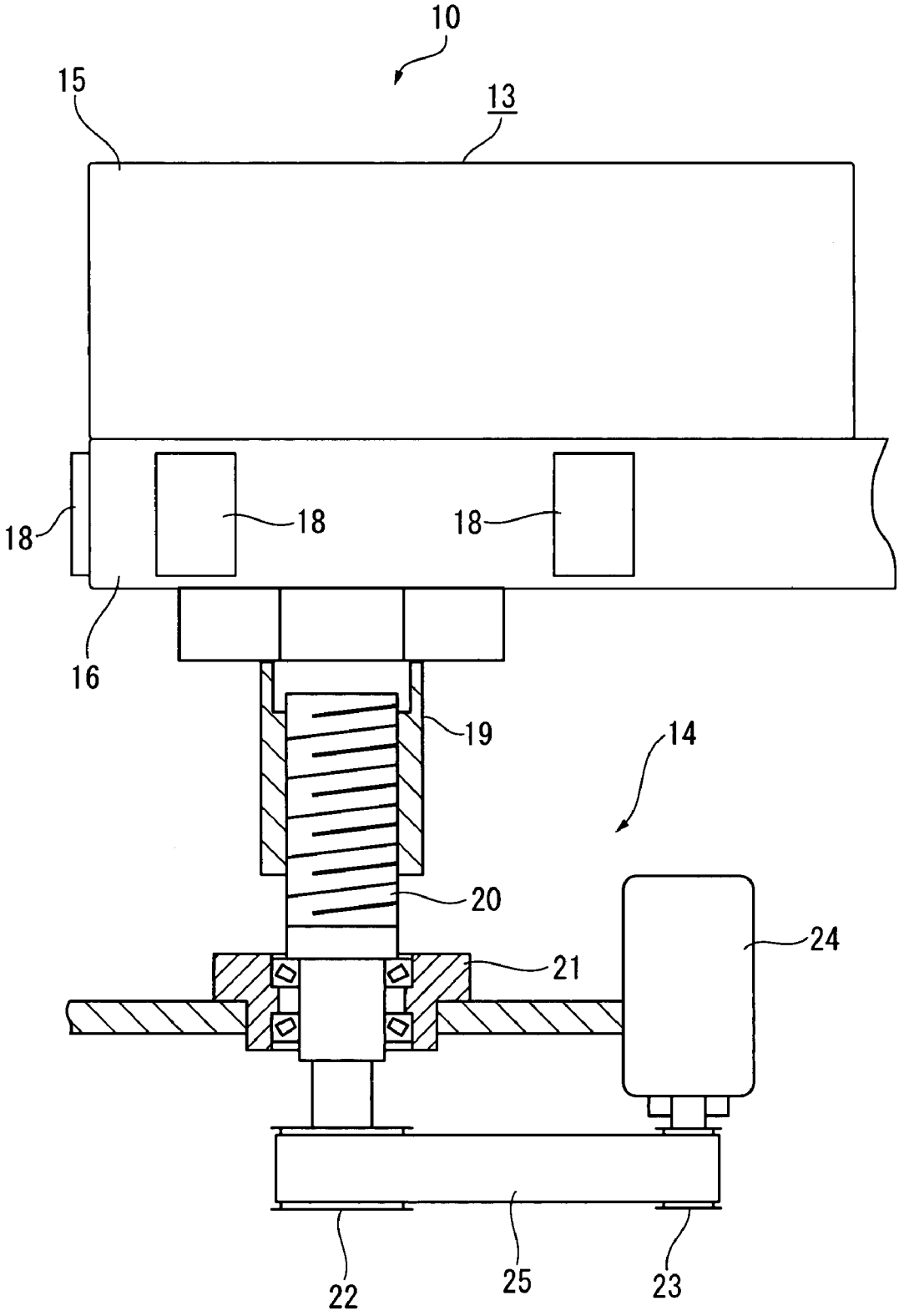
FIG. 5 is an enlarged view showing a biasing force generating means of the die-cushion device.

As shown in FIGS. 1 and 5, the biasing force generating means 14 provided to the die-cushion device 10 includes: a nut portion 19 provided on a lower surface of the large pad 16; a ball screw portion 20 screwed to the nut portion 19; a shaft bearing member 21 provided on the floor portion 65 of the bed 6 to rotatably support a lower end side of the ball screw portion 20; a driven-side pulley 22 provided on a lower end of the ball screw portion 20; and a servo motor 24 having a drive-side pulley 23. The servomotor 24 is supported by an arbitrary portion such as the floor portion 65, and a belt 25 is wound around each of the pulleys 22, 23.

In the present embodiment, four biasing force generating means 14 are provided corresponding to each of the small pads 15. A rotation of each of the servomotors 24 is individually controlled by a controller. The rotation shaft of the servomotor 24 of the biasing force generating means 14 is forward-reverse rotated when electricity is supplied. When the servomotor 24 is supplied with electricity to rotate the rotation shaft, and the drive-side pulley 23, the driven-side pulley 22 and ball screw portion 20 are rotated. In accordance with the rotary movement of the ball screw portion 20, the nut portion 19 is linearly moved in the lifting direction. Consequently, the die-cushion pad 13 is lifted up and down in conjunction with the nut portion 19. A cushion pressure (biasing force) applied to the die-cushion pad 13 is controlled by controlling the electric current supplied to the servomotor 24.

Figure 6:
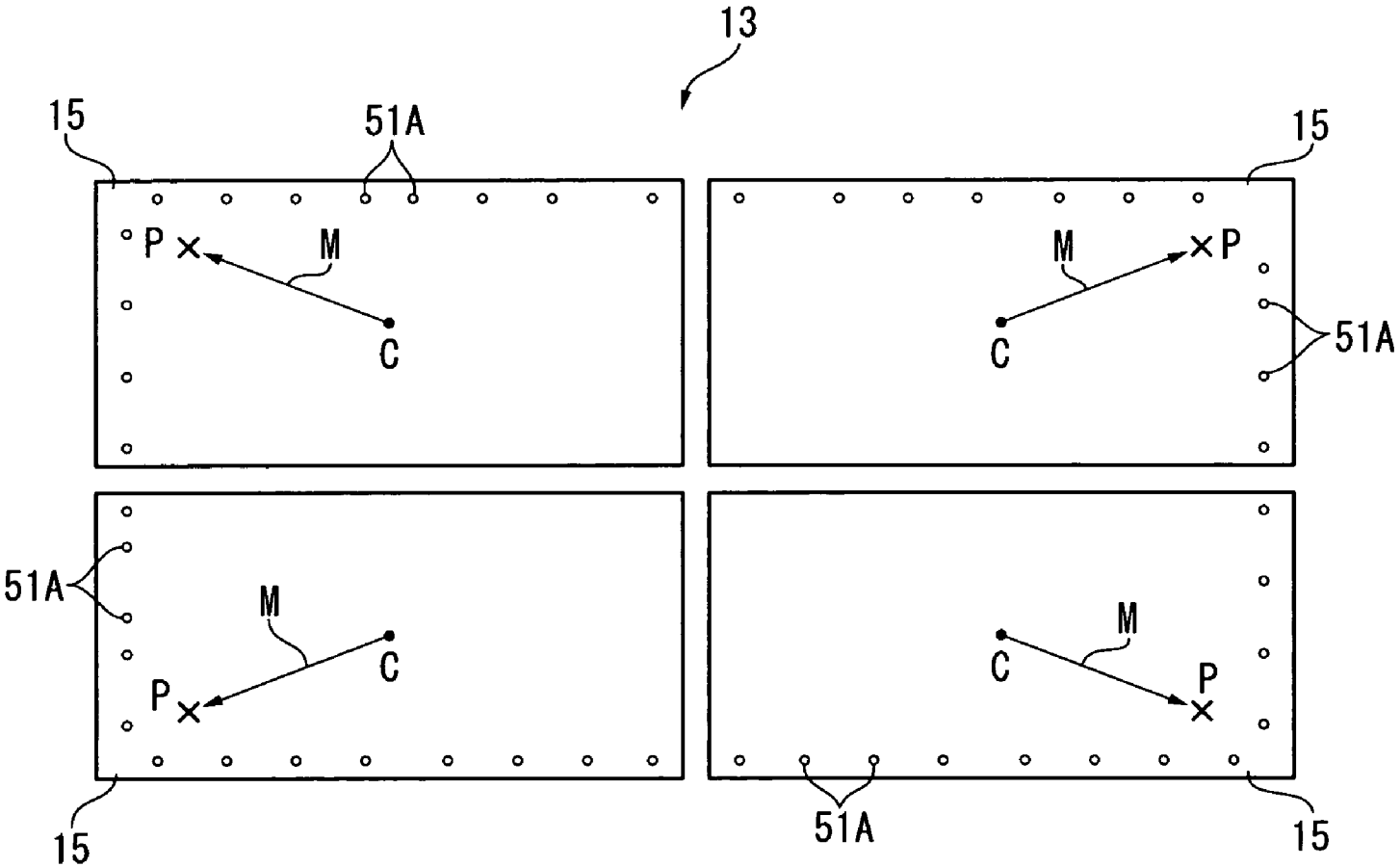
FIG. 6 is an illustration explaining an effect according to the embodiment.

In the above-described present embodiment, the die-cushion pad 13 is divided into the plurality of small pads 15 and the large pad 16. Accordingly, as schematically shown in FIG. 6, a load applied to an action point P of each of the small pads 15 can be equalized by the large pad 16, and an overturning moment M arising between the action point P and a reaction force point C that equates with the center of the small pad 15 can be cancelled, whereby the small pad 15 can be prevented from being flexed. Accordingly, since flexure of the cushion pin 12 and the like can be prevented, there is no risk that the cushion pin 12 is frictioned against the penetrating hole 51A of the bolster 51, and the lifting operation can be smoothly performed, whereby a higher-accuracy pressing forming operation can be realized. Note, however, that FIG. 6 illustrates only the penetrating holes 51A that are used.

Particularly, in the present embodiment, the small pad 15 is divided into four parts, each of which is arrayed in two lines and two rows and located at a position point-symmetric in relation to the center of the large pad 16. Accordingly, the overturning moment M arising on each of the small pads 15 can be reliably canceled, and the overturning moment can be close to zero when seen from the large pad 16 side. Thus the arrangement is advantageous.

In addition, since the small pad 15 that is vulnerable to flexure contacts neither the inner walls of the bed 6 nor the rib 62 and is applied with no reaction force, a stable cushion pressure can be applied to the die-cushion pad 13, thereby facilitating the control of the biasing force generating means 14.

Incidentally, the present invention is not limited to the embodiment described above, but includes other arrangements as long as an object of the present invention can be achieved, which also includes the following modification.

Figure 7:
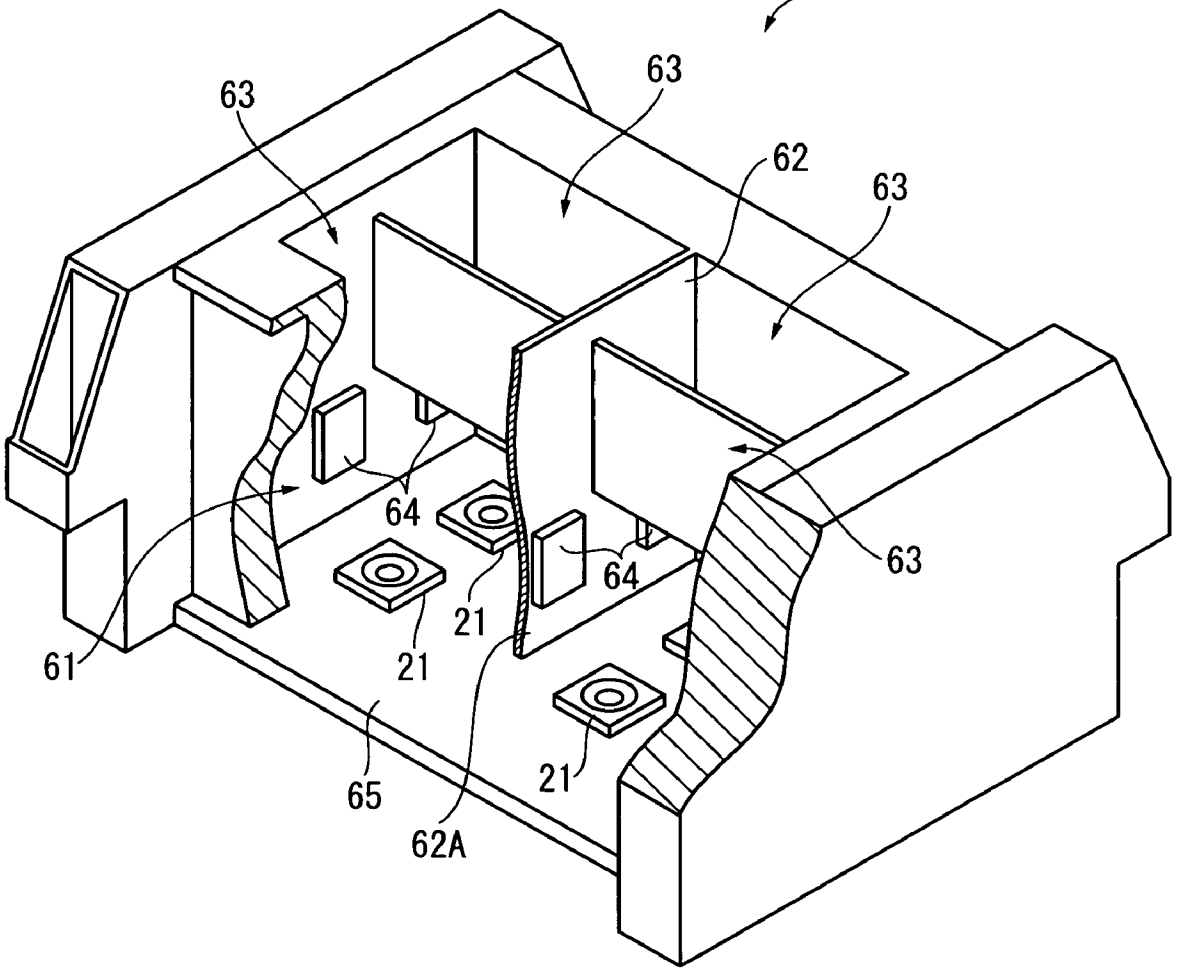
FIG. 7 is an illustration showing a modification of the present invention.
Figure 8:
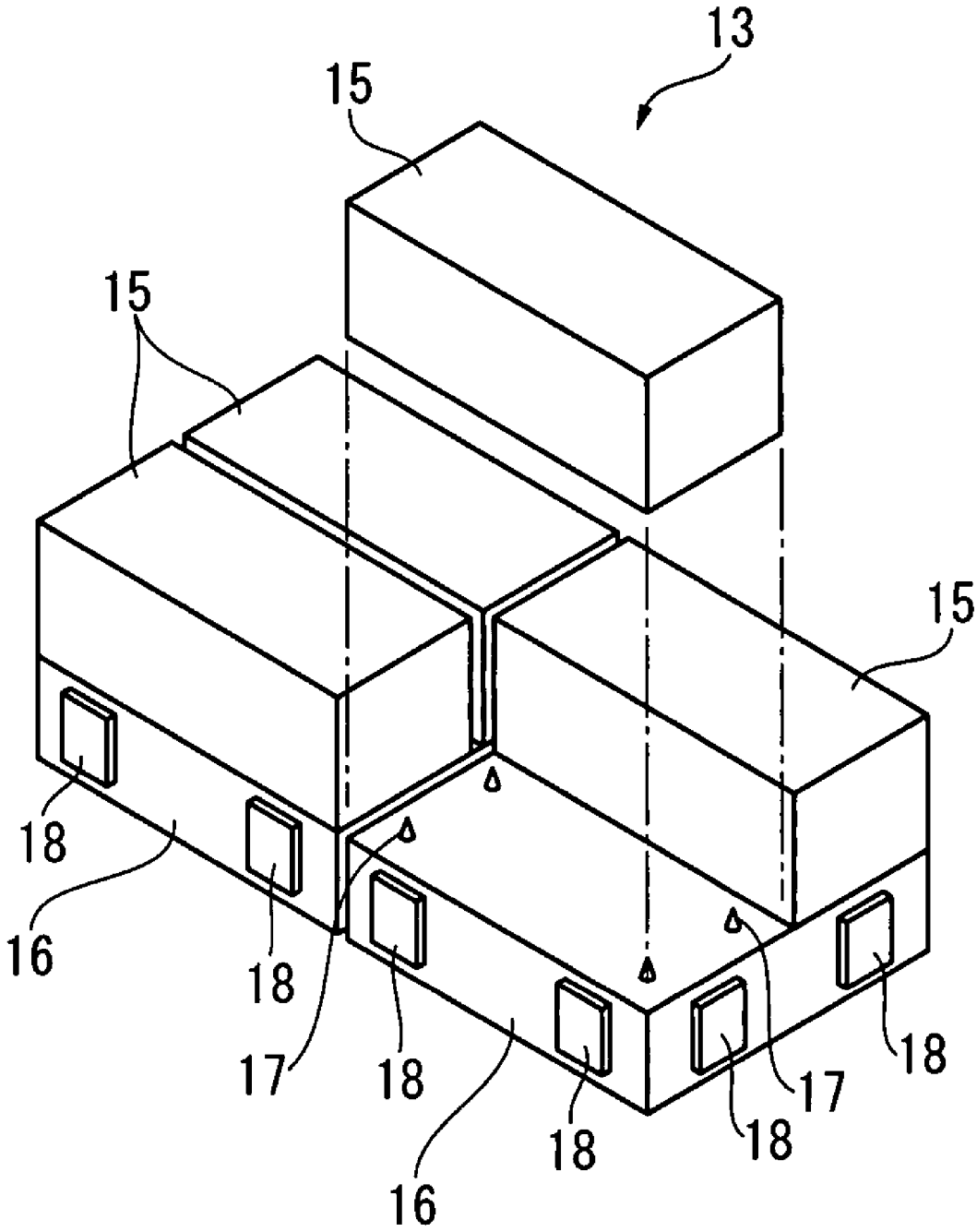
FIG. 8 is a perspective view showing a die-cushion pad used in the modification.

Although the cross-shaped rib 62 provided on the bed 6 is provided such that the lower end side extends only to the middle of the up-and-down direction of the inner space 61 in the above-described embodiment, a rib portion 62A that is, for example, provided along a short side of the rib 62 may extend to the floor portion 65 as shown in FIG. 7. In such a case, as shown in FIG. 8, the large pad 16 of the die cushion pad 13 is substantially half in size as compared with the large pad explained in the above embodiment, and a pair of large pads 16 are provided so as not to interfere with the rib 62. The scope of the present invention includes such a die cushion pad 13 since each of the large pads 16 also supports the plurality of small pads 15 (in this example, two pads). In addition, instead of the rib portion provided along the short side of the rib 62, a rib portion provided along a long side of the rib 62 may extend to the floor portion 65.

Although the cross-shaped rib 62 is provided on the bed 6 in the above-described embodiment, the rib 62 may be of any shape, such as a straight line shape. For instance, when a straight-line shaped rib is formed along a short side of the inner space 61, a pair of small pads 15 will be arrayed on the large pad 16 having such a size as described in the above embodiment. However, the small pad 15 in this case is substantially double in size as compared with the small pad explained in the above embodiment.

Further, in the present invention, the rib 62 of the bed 6 and a rib of the carrier 52 explained in the above embodiment may be provided as necessary. Such ribs are appropriately provided in accordance with flexure of the bolster 51.

Although, in the above embodiment, the small pad 15 and large pad 16 are integrally bolted together, the small pad 15 may be indirectly biased against the upper side of the large pad 16 by use of any biasing means.

Separately provided with a driving means, the small pad 15 may be lifted up and down separately from the large pad 16, and in such a case, the driving means may be housed, for example, inside the large pad 16. The lifting movement of both the small pad 15 and the large pads 16 is collectively controlled by the controller.

Although the die-cushion pad 13 is driven by the servomotor 24 in the above-described embodiment, the die-cushion pad 13 may be driven by a hydraulic actuator, pneumatic actuator and linear motor. Any arrangement of the biasing force generating means may be employed. As described above, the biasing force generating means may be air-cylinder type using air compressibility.

The number of the biasing force generating means 14 may be determined in any manner, which is not necessarily equivalent to the number of the small pads 15.

Although the best arrangement and method for implementing the present invention has been disclosed above, the present invention is not limited thereto. In other words, while the present invention has been described with reference to the specific embodiments and the drawings thereof, various modifications may be made to the disclosed embodiments by those of ordinary skill in the art without departing from the spirit and scope of the invention.

Therefore, the description that limits the shapes and the materials, especially of the small pad 15 and large pad 16, is only an example to make the invention easily understood, but is not intended to limit the invention The invention includes the description using a name of component without a part of or all of the limitation on the shape and the material etc.

INDUSTRIAL APPLICABILITY

The present invention is applicable to any pressing machines having a die-cushion device.

What is claimed is:

1. A pressing machine, comprising:

a bed having an inner space and a rib that partitions the inner space into a plurality of small spaces; and a die-cushion device comprising:

a plurality of small pads applied with a pressing force of a slide via a cushion pin;

a large pad supporting the plurality of small pads; and a plurality of biasing force generating units, each controlled by an electric motor, for moving the large pad up and down while generating an upward biasing force against the pressing force, wherein a die cushion pad is provided by the small pads and the large pad, wherein the die-cushion pad is arranged in the inner space of the bed, and wherein the small pads are movable up and down in the small spaces partitioned from the inner space of the bed by the rib.

2. The press machine according to claim 1, wherein the small pads and the large pad are integrally fixed together.

3. The press machine according to claim 1, wherein only the large pad is guided to be moved up and down by an inner wall of the bed of the pressing machine.

4. The press machine according to claim 1, wherein the plurality of small pads consists of four small pads and the four small pads are disposed in two lines and two rows, and the large pad is a single pad supporting the four small pads.

5. The press machine according to claim 4, wherein the small pads are located at a position point-symmetric in relation to a center of the large pad.

6. The press machine according to claim 1, wherein the large pad supports the small pads from below.

7. The press machine according to claim 1, wherein the large pad is provided below the rib.

8. The press machine according to claim 1, wherein the biasing force generating units are arranged in correspondence with positions of the small pads, respectively.

9. The press machine according to claim 1, wherein each of the small pads is arranged in a respective one of the small spaces.

10. The press machine according to claim 1, wherein the rib is a cross-shaped rib.

11. A pressing method, comprising:

using a pressing machine including: a bed having an inner space and a rib that partitions the inner space into a plurality of small spaces; a plurality of small pads arranged in the small spaces to be movable up and down and applied with a pressing force of a slide via a cushion pin; a large pad supporting the plurality of small pads, in which a die cushion pad is provided by the small pads and the large pad; and a plurality of biasing force generating units, each controlled by an electric motor, and moving, by the plurality of biasing force generating units, the large pad up and down while generating an upward biasing force against the pressing force.

12. The pressing method according to claim 11, wherein the small pads and the large pad are integrally fixed together.

13. The pressing method according to claim 11, wherein only the large pad is guided to be moved up and down by an inner wall of the bed of the pressing machine.

14. The pressing method according to claim 11, wherein the plurality of small pads consists of four small pads and the four small pads are disposed in two lines and two rows, and the large pad is a single large pad supporting the four small pads.

15. The pressing method according to claim 14, wherein the small pads are located at a position point-symmetric in relation to a center of the large pad.

16. The pressing method according to claim 11, wherein the large pad supports the small pads from below.

17. The pressing method according to claim 11, wherein the large pad is provided below the rib.

18. The pressing method according to claim 11, wherein the biasing force generating units are arranged in correspondence with positions of the small pads, respectively.

19. The pressing method according to claim 11, wherein each of the small pads is arranged in a respective one of the small spaces.

20. The pressing method according to claim 11, wherein the rib is a cross-shaped rib.

* * * * *